United States Patent [19]

Kimberley et al.

[11] Patent Number: 4,484,867

[45] Date of Patent: Nov. 27, 1984

[54] MOUNTING ARRANGEMENT FOR FUEL RACK IN FUEL INJECTION PUMP

[75] Inventors: John A. Kimberley, East Granby, Conn.; John B. Cavanaugh, West Springfield; Richard D. Kraus, Chicopee, both of Mass.

[73] Assignee: Ambac Industries, Incorporated, Springfield, Mass.

[21] Appl. No.: 467,557

[22] Filed: Feb. 17, 1983

[51] Int. Cl.[3] ..... F04B 7/04

[52] U.S. Cl. ..... 417/499

[58] Field of Search ..... 417/289, 494, 490, 499; 123/373, 500, 503, 495, 372, 364

[56] References Cited

U.S. PATENT DOCUMENTS

| | | | |
|---|---|---|---|
| 1,665,692 | 4/1928 | Ensign | 417/499 |
| 1,967,101 | 7/1934 | Rassbach | 123/495 |
| 2,287,478 | 6/1942 | Johnston | 123/373 |
| 3,179,053 | 4/1965 | Jordan | 417/499 |
| 3,934,568 | 1/1976 | Malyshev | 123/373 |
| 4,329,961 | 5/1982 | Johnston | 123/502 |

FOREIGN PATENT DOCUMENTS

| | | | |
|---|---|---|---|
| 57-108418 | 7/1982 | Japan | 123/373 |

*Primary Examiner*—Leonard E. Smith
*Assistant Examiner*—Jane E. Obee
*Attorney, Agent, or Firm*—Stephen A. Schneeberger

[57] ABSTRACT

An improved fuel rack mounting arrangement, particularly for use in an in-line pump, is structured to reduce actuating forces. The fuel rack is supported by a pair of lever arms pivotally connected thereto at longitudinally spaced pivot axes. Each lever arm is also pivotally connected to the pump housing at separate pivot axes. The orientation and positioning of the various pivots are such as to afford longitudinal reciprocation of the rack in response to actuation of one of the levers about its pivot axis by which it is connected to the housing. The actuation may be provided by a stepper motor acting on an extension of the lever. Each lever may include an integral pivot pin and a locking mechanism for captured pivotal mounting of the rack.

7 Claims, 4 Drawing Figures

MOUNTING ARRANGEMENT FOR FUEL RACK IN FUEL INJECTION PUMP

DESCRIPTION

1. Technical Field

The present invention relates to fuel injection pumps and more particularly to the fuel rack contained in such fuel injection pumps. More particularly still, the invention relates to an improved mounting arrangement for a fuel rack in a fuel injection pump.

2. Background Art

In various fuel injection pumps, a parameter of the fuel injection process, such as fuel quantity, may be controlled by a fuel rack. The fuel rack, particularly in serial or in-line pumps, is an elongated member which is longitudinally reciprocated to angularly adjust respective pump plungers, or pistons, housed in the series of respective cylinders or injection barrels. Such angular adjustment of a pump piston is operative to vary the effective delivery stroke of that piston and thereby control the quantity of fuel injected during a respective delivery stroke. In such fuel injection pumps, the fuel rack is supported in respective bearing sleeves at two or more locations along its length. Such bearing typically allows the fuel rack to be linearly reciprocated or to slide along its length without any transverse displacement. Examples of such fuel rack guides are illustrated and described in U.S. Pat. No. 3,883,274 to A. Vuaille and in U.S. Pat. No. 3,804,559 to H. Staudt et al. In such fuel injection pumps, the fuel rack is typically actuated by a manual force such as a foot actuated accelerator and/or by a mechanical or hydraulic governor. In such instances, the actuating force applied to the fuel rack may be required to be relatively large, as for instance in the neighborhood of eight pounds when the pump is cold, as during start-up. The required force may decrease considerably when the pump warms up, yet remains at a significant level, as for instance one pound.

It is typically desirable to reduce the forces required to actuate mechanism such as the fuel rack in order to extend the life of the actuator and/or minimize the manual forces involved. With the increasing application of electrically controlled and electrically powered actuators for controlling various parameters of a fuel injection pump, the need to minimize the actuating forces is further accentuated. For instance, an electrically controlled stepping motor capable of providing the driving force necessary to actuate a fuel rack mounted in a conventional manner is relatively large and expensive.

Accordingly, it is a principal object of the present invention to provide an improved arrangement for mounting the fuel rack in a fuel injection pump. Included within this object is the provision of a fuel rack mounting arrangement which significantly reduces the forces required to actuate the fuel rack during both cold and warm operating conditions. Further included within this object is the provision of a fuel rack mounting arrangement which is relatively simple to manufacture and assemble.

It is a further object of the present invention to provide a fuel rack and mounting arrangement therefor which is particularly suited for actuation by an electrically controlled and powered actuator, such as a stepper motor.

In accordance with the present invention, there is provided an improved fuel rack mounting arrangement, particularly for use in in-line fuel injection pumps. The force required to actuate the fuel rack is significantly reduced by pivotally mounting the fuel rack, rather than using conventional sliding bearing surfaces. More specifically, two or more lever arms may be pivotally mounted to the pump housing at respective primary pivot locations, the axes of those primary pivots being parallel to and spaced from one another. Each lever arm is then pivotally connected to the fuel rack at respective secondary pivots, the axes of those secondary pivots being parallel to and spaced from the primary pivot axes and, at least longitudinally of the fuel rack, from one another. The fuel rack is thus longitudinally reciprocable in response to a respective actuating force applied to at least one of the lever arms. In a typical situation, the actuating force is applied by an electrically controlled and powered stepper motor. In the illustrated embodiment, one of the lever arms extends beyond the primary pivot in a direction generally opposite to the direction of the secondary pivot for receiving the actuating force at a terciary pivot.

According to one embodiment, the secondary pivots on each of the lever arms is provided by a respective pivot pin affixed to the lever arm, and that lever arm further includes a locking mechanism formed integrally therewith. Both the rack and the locking mechanism of the lever arm are cooperatively structured such that the rack may be pivotally mounted onto each secondary pivot pin at a respective loading angle between the rack and the lever arm, and each lever arm is normally operable through a range of respective operating angles relative to the rack, which range of operating angles excludes the loading angle so as to maintain the rack in locked pivoting engagement therewith.

BEST MODE FOR CARRYING OUT THE INVENTION

Figure 1:
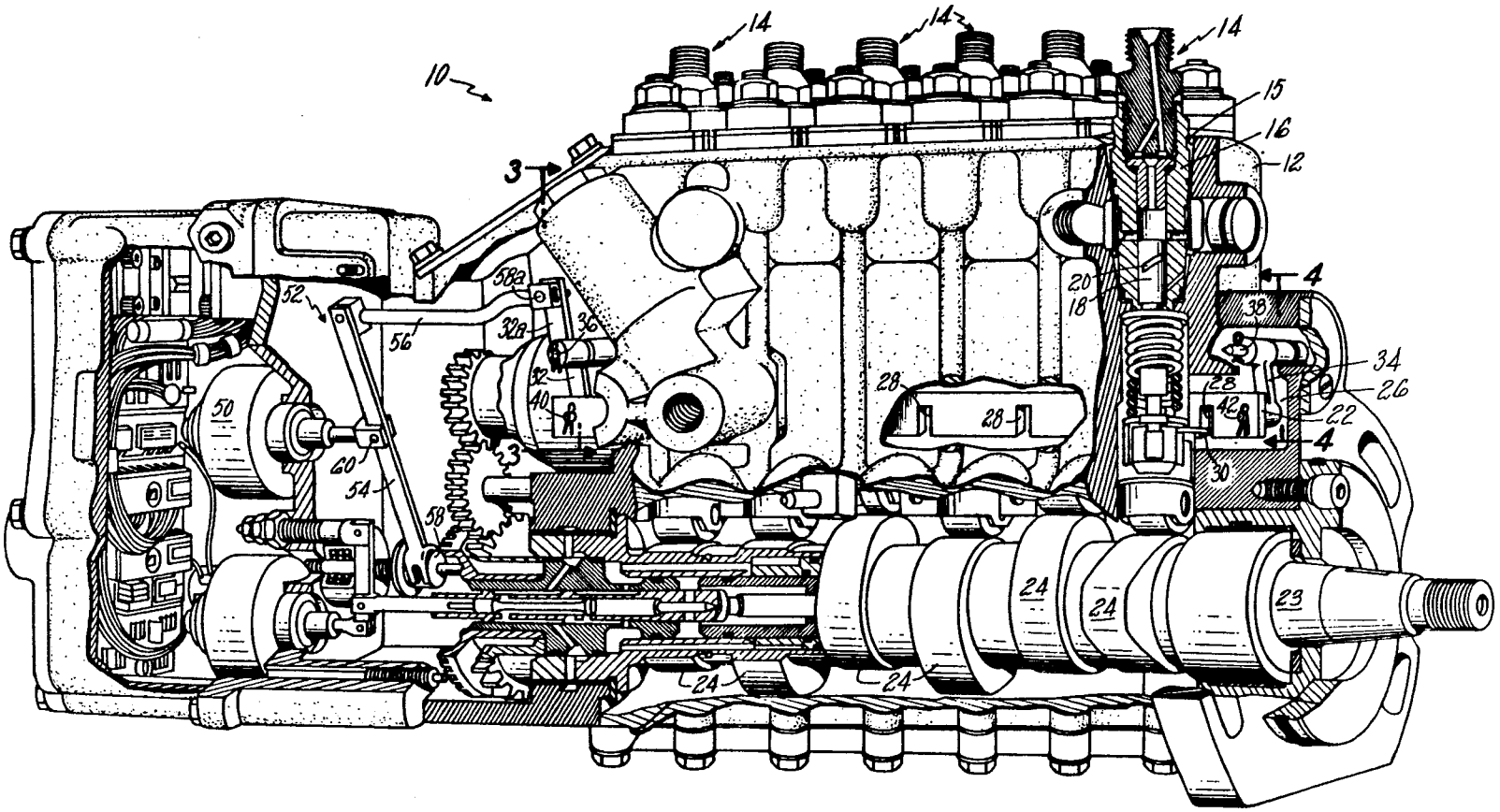
FIG. 1 is a perspective view of an in-line fuel injection pump, partly broken away to illustrate one embodiment of the fuel rack mounting arrangement of the invention.

Referring to FIG. 1, there is illustrated a fuel injection pump 10, having a pump housing 12 in which is disposed a plurality of unit pumps 14 (in this instance six). The unit pumps 14 are serially arranged in parallel alignment and each comprises an injection barrel 16 disposed in a respective housing bore 15 and containing a respective slidable pump piston 18. Each pump piston 18 is provided with an oblique control edge 20 and is angularly adjustable by means of a longitudinally reciprocable fuel rack 22 for altering the effective delivery stroke. A cam shaft 23 containing cams 24 is rotated to effect the respective delivery strokes of the respective pistons 18 arranged therealong.

The fuel rack 22 is a stamped sheet metal element, and may be relatively elongate and flat. The fuel rack 22 typically extends transversely of the longitudinal axes of the several pistons 18 and longitudinally within a cavity 26 extending most of the distance between the front and the rear of the pump housing 12. A series of vertical slots 28 are formed in the rack 22. Into each slot 28 extends the rounded head of a connecting arm 30 attached to a respective pump piston 18. The connecting arm 30 forms part of a regulator sleeve which controls the angular orientation of the respective piston 18. The vertical slots 28 are necessitated in part because the connecting arms 30 move vertically within housing 12 during reciprocation of pump pistons 18 and in part because of a relative vertical motion of the rack 22 within housing 12 for a reason which will become evident upon further description of the invention.

In accordance with the invention, the fuel rack 22 is mounted in a manner which affords it longitudinal reciprocable motion, albeit somewhat nonlinear, without the need for sliding bearing surfaces possessing relatively high friction. More specifically, the rack 22 is reciprocated via rotary or pivotal motion about the various support bearing surfaces rather than requiring linear sliding motion. Each of a pair of lever ars 32 and 34 is pivotally mounted for rotation relative to pump housing 12 about a respective primary axis defined by respective pivot pins 36 and 38. The pivot pins 36 and 38 are parallel to one another, extend substantially normal to the axes of the pump pistons 18 and are spaced longitudinally of the pump housing 12 at relative forward and rearward positions therein. Each pivot pin 36, 38 may be rigidly affixed to either the housing 12 or the respective lever arm 32, 34, with the other free for relative pivotal rotation thereabout, or both may be capable of pivotal rotation relative to the respective pivot pin. In the embodiment of FIG. 1, pivot pins 36 and 38 extend through an opening in the wall of housing 12 and a clearance opening in the respective lever arms 32, 34. The relative axial positions are maintained, as by providing a head on the outer end and a removable fastening pin on the inner end of each of the pivot pins 36, 38.

The lever arms 32, 34 are each pivotally connected to the rack 22 at respective secondary pivot axes defined by pivot pins 40, 42 to allow relative pivotal motion therebetween. The pivot pins 40, 42 extend parallel to and are spaced from the respective primary pivot pins 36, 38. Each pivot pin 40, 42 may be rigidly affixed to either the rack 22 or the respective lever arm 32 or 34, with the other free for relative pivotal rotation thereabout, or both may be capable of pivotal rotation relative to the respective pivot pin. In the embodiment of FIG. 1, the secondary pivot pins 40, 42 are press-fitted into lever arms 32, 34 respectively, and the free ends of those pivot pins extend, with radial clearance, through openings in rack 22 near the longitudinal extremeties thereof. The rack 22 is axially retained on the pivot pins 40, 42, as by removable fastening pins in this embodiment.

The lever arms 32, 34 may be of cast metal, with the various bearing or contact surfaces being machined for smoothness. The lever arms may also be relatively thin except in those regions which mount or are mounted on, the respective pivot pins.

Thus it will be seen that an actuating force applied to either of the lever arms 32, 34 at a distance from the primary pivot pins 36, 38 will result in pivotal rotation of that arm about that respective axis. Correspondingly, because of the remaining pivotal connections between the housing 12, the other lever arm 32 or 34, and the rack 22, the rack will be moved longitudinally forward or rearward, depending on the direction of the applied actuating force and its location on the lever arm. This pivotally-suspended rack 22 can be actuated by a force of only several ounces when cold, and even less when warm.

In the illustrated embodiment, the lever arm 32 includes a portion **32*a* extending from the primary pivot axis in a direction substantially opposite from that of the secondary pivot axis. The actuating force is conveniently applied to this portion 32*a* of lever arm 32, making the lever arm of the first-class type, with the result that the rack 22** is displaced in a direction generally opposite to that of the applied actuating force.

It will be understood that the actuating force may be applied, depending on its directional sense, almost anywhere along lever arm 32 other than at the primary pivot 36; however the illustrated arrangement is particularly convenient within the geometry of the present pump 10. Moreover, such arrangement may provide desirble balancing of the acceleration or deceleration inertias of the rack 22 and the moving parts of the actuator mechanism. While this latter characteristic may be relatively unnecessary in a system having an electrical actuator, it may be highly desirable in a system employing a centrifugal mechanical governor having a governor fulcrum lever of large mass. In such systems of the latter type, the governor fulcrum lever and the rack have typically been oriented and interconnected such that upon sudden deceleration of the vehicle, the inertias of the fulcrum lever and the rack additively combined to displace the rack in an unwanted manner. On the other hand, with the present use of a first-class transfer lever 32 in which the primary pivot 32, or fulcrum, is located between the point at which the rack 22 is connected and the point at which the actuator mechanism applies its force, the inertias of those two masses will act in opposition to one another through the lever and thus, will generally be balanced during deceleration and acceleration.

An actuator, such as the electrically-controlled and electrically-powered linear stepper motor 50, operates through linkage 52 to apply the requisite actuating force to arm-portion **32*a* of lever arm 32. The linkage 52 may take a variety of forms, with that illustrated in FIG. 1 comprising a base lever 54 and a connecting arm 56. The base lever has a fulcrum 58 which may be fixed or may be translatable. The connecting arm 56 at one end is pivotally connected to the upper end of base lever 54, and at its other end pivotally engages the arm portion 32*a* of lever arm 32, as through a pivot pin 58*a*. The actuator 50 may pivotally engage base lever 54 intermediate its ends, as through a pivot pin 60, for transmitting the actuating force by angularly displacing base lever 54**.

Figure 2:
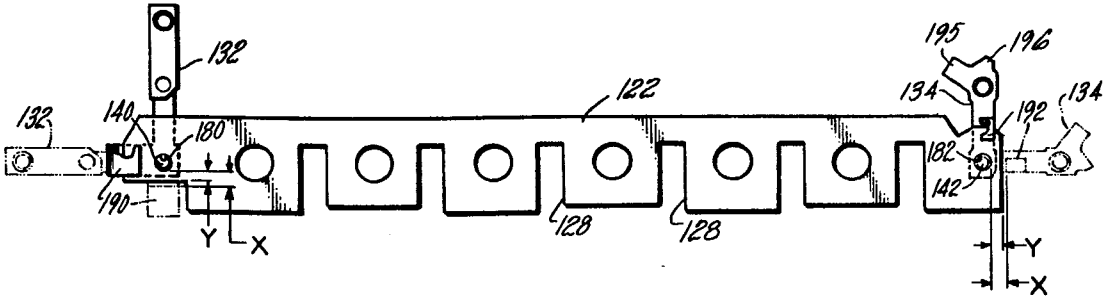
FIG. 2 is an enlarged side elevational view showing a fuel rack pivotally connected to a pair of lever arms in another embodiment.

Referring now to FIG. 2 there is illustrated another embodiment of the invention in which the geometry of the lever arms 132, 134 and the rack 122 is cooperatively such that the rack is axially retained on the pivot pins 140, 142 press-fitted in the lever arms without requiring separate, removable fastening means. Firstly, the rack 122 includes a pair of pivot openings 180 and 182 extending therethrough near the opposite extremes thereof, each opening being either very near the rack end, as opening 182, or very near the underside edge, as opening 180, for a reason to become evident. Secondly, each lever arm 132, 134 includes a generally L-shaped retaining member or lock 190, 192 respectively. The leg portion of each L-shaped lock 190, 192 extends outwardly from the main lever arm parallel to and spaced from the respective pivot pins 140, 142, and the foot portion of each lock extends transversely of the leg portion generally toward the respective pivot pins 140, 142. The length of the leg portion of locks 190, 192 is slightly greater than the thickness of the rack 122 to allow the rack to be mounted on pivot pins 140, 142. Importantly, the foot portion of each lock extends less than the entire distance to the respective pivot pin 140, 142, leaving a small gap of width X, as illustrated in the FIG. 2. Further, the opening 180, 182 in rack 122 are spaced from the lower edge or from the end thereof by a distance Y, also shown in FIG. 2, which is less than the gap X between the pivot pins 140, 142 and the foot of the respective locks 190, 192. Thus, the lever arms 132, 134 may be assembled or mounted onto rack 122 by placing them in the particular angular orientations, shown in phantom in FIG. 2, in which the narrow, Y-dimensioned sections of the rack may relatively pass through the X-dimensioned gap between the locks 190, 192 and respective pivot pins 140, 142.

Figure 3:
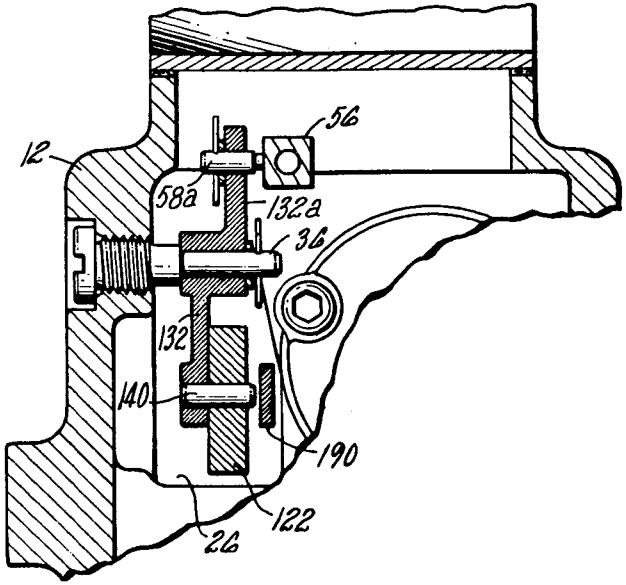
FIG. 3 is a sectional view of the pump of FIG. 1, taken along line 3—3 thereof, but incorporating the rack mounting arrangement of FIG. 2.
Figure 4:
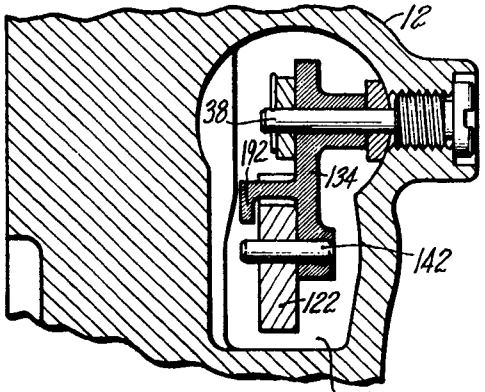
FIG. 4 is a sectional view of the pump of FIG. 1, taken along line 4—4 thereof, but incorporating the rack mounting arrangement of FIG. 2.

Once the rack 122 is mounted on the pivot pins 140, 142 of lever arms 132, 134, those lever arms are then rotated approximately 90° (one clockwise, the other counterclockwise) to the normal operating positions shown in solid line in FIG. 2. In these normal operating orientations, which may include an angular range of ±30°–40° from that depicted, the foot portion of locks 190, 192 now extend inwardly over portions of rack 122 which extend beyond holes 180, 182 by dimensions greater than X. Thus, the rack 122 is retained on the pivot pins 140, 142 by the locks 190, 192 during normal operating orientations, as seen also in FIGS. 3 and 4.

One or both of lever arms 132, 134 may also be provided with limit appendages, such as tabs 195 and 196 on lever arm 134, for engagement with stops (not shown) mounted on housing 12 to define the limits of displacement of rack 122.

In the illustrated embodiment of an injection pump 10 in which the rack is moved by an electrical stepper actuator 50, the stepper drives the lever arms and rack both rightward (increased fuel) and leftward (decreased fuel), as seen in FIG. 1, without relying upon a return spring for actuation in one of those directions or for reducing backlash; however it will be appreciated that such a spring might be employed if circumstances require. Rapid shut-off of fuel may be accomplished in a known manner by a solenoid-controlled valve operating to prevent delivery of fuel to the region of each unit pump 14.

While the present invention may be of greatest benefit in pumps employing electrically-controlled actuators, the reduction in the required actuating force is also of benefit in mechanically-governed pumps. In such application, the actuating force is typically provided through a known mechanical load-control mechanism (not shown) including an accelerator mechanism and a fly-weight governor. However, it is also common to provide a shut-off mechanism (not shown) whereby manual rotation of a spring-biased shaft causes an appendage on the shaft to engage one of the lever arms or the rack and thereby urges the rack to a "no-fuel" limit position. In fact, most existing mechanical shutoff arrangements might be suitably employed with the rack suspension arrangement of the present invention.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to be secured by Letters Patent of the United States is:

1. In a fuel injection pump including a pump housing, at least one injection barrel inserted in said pump housing, a respective pump piston positioned in each said at least one injection barrel, a cavity provided in said pump housing, an elongated fuel rack extending transversely of said at least one pump piston within said housing cavity, means connecting said fuel rack with each said at least one pump piston for altering its angular position in its injection barrel upon longitudinal displacement of said fuel rack for changing the effective delivery stroke of said pump piston, the improvement comprising:

at least two lever arms, each said lever arm being pivotally mounted to said pump housing at a respective primary pivot, the axes of said primary pivots being parallel to and spaced from one another, each said lever arm also being pivotally connected to said fuel rack at respective secondary pivots to pivotally support said fuel rack, the axes of said secondary pivots being parallel to and spaced from said primary pivot axes and, at least longitudinally of said fuel rack, from one another, at least one of said levers being reciprocably actuable about its said primary pivot axis thereby to longitudinally reciprocate said fuel rack.

2. The fuel injection pump of claim 1 including a plurality of said injection barrels being arranged in serial alignment in said pump housing.

3. The fuel injection pump of claim 1 wherein said fuel rack is supportingly mounted in said pump housing by substantially only said pivotal connections at said respective secondary pivots of each of said at least two lever arms.

4. The fuel injection pump of claim 1 including an electrically-controlled and powered actuator, said actuator being operatively connected to one of said lever arms to effect said actuation thereof to thereby longitudinally reciprocate said fuel rack.

5. The fuel injection pump of claim 4 wherein said actuator is a stepper motor.

6. The fuel injection pump of claim 1 wherein said at least one actuable lever arm includes a drive portion extending beyond said first pivot axis in a direction other than toward said second pivot axis, said lever arm being actuated for pivotal rotation about its said first axis in the manner of a first-class lever by an actuating force applied to said drive portion thereof.

7. The fuel injection pump of claim 1 wherein said secondary pivots are provided by respective pivot pins affixed to the respective said lever arms, each said lever arm further including locking means formed integrally therewith, said rack and said lever arm locking means each being cooperatively structured such that said rack may be pivotally mounted onto each said pivot pin at a respective mounting angle between the rack and the respective said lever arm, each said lever arm being normally operable through a range of respective operating angles relative to said rack, and each said mounting angle being excluded from the respective said range of operating angles.

* * * * *